US005377756A

United States Patent [19]

Northrop et al.

[11] Patent Number: 5,377,756

[45] Date of Patent: Jan. 3, 1995

[54] METHOD FOR PRODUCING LOW PERMEABILITY RESERVOIRS USING A SINGLE WELL

[75] Inventors: Paul S. Northrop; James L. Wilson, both of Bakersfield, Calif.

[73] Assignee: Mobil Oil Corporation, Fairfax, Va.

[21] Appl. No.: 142,028

[22] Filed: Oct. 28, 1993

[51] Int. Cl.[6] ..... E21B 43/24; E21B 43/26; E21B 43/40

[52] U.S. Cl. ..... 166/267; 166/303; 166/306; 166/308

[58] Field of Search ..... 166/267, 297, 303, 306, 166/308

[56] References Cited

U.S. PATENT DOCUMENTS

| | | | |
|---|---|---|---|
| 2,970,645 | 2/1961 | Glass . | |
| 3,028,914 | 4/1962 | Flickinger . | |
| 3,118,499 | 1/1964 | Johnson et al. | 166/306 X |
| 3,163,211 | 12/1964 | Henley | 166/306 X |
| 3,289,762 | 12/1966 | Schell et al. . | |
| 3,353,602 | 11/1967 | Geertsma | 166/306 X |
| 3,490,527 | 1/1970 | Cook et al. | 166/245 |
| 3,712,379 | 1/1973 | Hill | 166/297 |
| 4,424,859 | 1/1984 | Sims et al. | 166/67 |
| 4,711,304 | 12/1987 | Boeke et al. | 166/303 |
| 4,867,241 | 9/1989 | Strubhar | 166/308 |
| 4,889,186 | 12/1989 | Hanson et al. | 166/308 X |
| 5,018,578 | 5/1991 | El Rabaa et al. | 166/281 |
| 5,161,618 | 11/1992 | Jones et al. | 166/308 |
| 5,247,993 | 9/1993 | Sarem et al. | 166/303 |

OTHER PUBLICATIONS

"Hydraulic Fracturing", *Petroleum Engineer*, Jul. 1961.

*Primary Examiner*—George A. Suchfield
*Attorney, Agent, or Firm*—Alexander J. McKillop; George W. Hager, Jr.

[57] ABSTRACT

A method for recovering connate fluids (e.g. oil) from a low permeability subterranean reservoir (e.g. diatomite) through a single wellbore. Upper and lower intervals are fractured from the wellbore that the fractured intervals only partially overlap, thereby leaving a partial, natural barrier formed of random-spaced, low permeable areas along the interface between the fractured intervals. This partial barrier improves the sweep efficiency of a drive fluid (e.g. water) which is injected into the lower fractured interval by forcing it to spread outward into the reservoir before it is flows through the upper fractured interval. The drive fluid is injected at approximately the same rate as that at which the fluids are produced so that displacement of oil occurs primarily due to imbibition.

10 Claims, 1 Drawing Sheet

METHOD FOR PRODUCING LOW PERMEABILITY RESERVOIRS USING A SINGLE WELL

DESCRIPTION

1. Technical Field

The present invention relates to the production of fluids from low permeability reservoirs and in one of its aspects relates to a method for producing connate fluids (e.g. hydrocarbons) from a low permeability reservoir (e.g. diatomite) through a single well wherein the reservoir is fractured in a specific pattern to improve the sweep efficiency of the drive fluid (e.g. water) used in the recovery operation.

2. Background Art

Substantial reserves of hydrocarbons (e.g. oil) are known to exist in reservoirs which have very low permeabilities. For example, billons of barrels of oil of proven reserves are known to be trapped in diatomaceous reservoirs in California, alone. A diatomaceous reservoir (i.e. formed primarily of diatomite) is characterized by high porosity, high compressibility, and very low permeability (e.g. as low as 0.1 millidarcy) which makes the recovery of oil from these reservoirs extremely difficult.

Most commonly-used secondary recovery operations are normally ineffective in producing any substantial amounts of oil from these reservoirs. That is, it is extremely difficult, if possible at all, to generate the high pressures required to produce an adequate flow of a drive fluid (e.g. water and/or gas) through the reservoir, especially in patterned floods where the drive fluid is injected through injection well(s) and then flowed through the formation to separate production wells.

Even where a single well has been proposed for use as both the injection and the production well, the extremely high pressures required to force a drive fluid (e.g. steam) through the reservoir between an injection interval and a production interval of the wellbore make such recovery operations expensive and, in most cases, still result in low oil recovery.

It is commonly known that the permeability of such reservoirs can be increased substantially by hydraulically fracturing the reservoir throughout a zone of interest, i.e. production zone. To recover the oil from this zone, a drive fluid (e.g. water, steam, etc.) is usually injected into the fractured injection well to drive the oil towards a fractured production well which, in turn, is spaced some distance away.

Unfortunately, in hydraulically fractured, low permeability reservoirs where a single well is used both as the injection and the production well, the drive fluid tends to follow the path of least resistance which normally lies adjacent and along the wellbore, itself. Accordingly, the drive fluid, as it is injected near the bottom of the fractured zone, tends to flow upward along this path adjacent the wellbore so that it does not flow outward into the reservoir to any substantial extent. This normally leads to early breakthrough at the production interval of the wellbore which, in turn, leaves a substantial portion of the production zone of the reservoir unswept and substantial amounts of the hydrocarbons therein unrecovered.

Another common problem which exists in the production of fluids from a diatomite reservoir is subsidence/compaction of the reservoir as the fluids are withdrawn. If the reservoir fluids are produced at a faster rate than the drive fluid is injected, the flow passages in the reservoir are apt to close or collapse thereby further decreasing the already low permeability of the reservoir.

SUMMARY OF THE INVENTION

The present invention provides a method for recovering connate fluids (e.g. oil) through a single wellbore from a low permeability subterranean reservoir of the type comprised primarily of diatomite. Upper and lower intervals of the reservoir are fractured from the wellbore so that the fractures in the respective intervals only partially overlap. This selective fracturing of the reservoir leaves or provides a partial, natural barrier which is formed of substantially unfractured, low permeable areas which are randomly-spaced along the interface between the fractured intervals.

A drive fluid (e.g. water, hot water, etc.) is injected into the lower fractured interval and flows upward towards the upper fractured interval. When the drive fluid contacts the partial barrier, it is forced to spread outward into lower fractured interval where it contacts and displaces greater volumes of oil from the reservoir. The fluid and displaced oil flows upward through the perturbable, overlapping fractures into and through the upper fractured interval from which they are produced.

More specifically, a single wellbore is completed and cased through a low permeability reservoir such as those found in diatomaceous formations. The casing has an upper and a lower set of perforations (perfs) which are strategically spaced from each other. The casing is isolated adjacent to one of the sets of perfs and a first interval of the reservoir is hydraulically fractured through these perfs. The fracture(s) which are created lie in a substantial vertical plane extending outward into reservoir and will have a height (i.e. distance parallel to the wellbore) which will extend substantially across the first interval (e.g. from about 50 to about 100 feet above and below the point where the fracturing fluid is injected).

After the first interval is fractured, a second portion of wellbore adjacent the upper set of perfs is isolated and a second interval of the reservoir is hydraulically fractured. The upper and lower sets of perfs are spaced from each other at a prescribed distance (i.e. from about 50 to about 100 feet, depending on a particular reservoir) so that all of the fractures created in the second interval will not overlap all of the fractures in the first interval. Instead, only some of the fractures will overlap so that the intervals will only be in partial fluid communication with each other.

That is, the respective fractures are spaced so that they "play-out" as they propagate toward the interface which exists between the fractures. Accordingly, the lower end of the upper fractures and the upper end of the lower fractures will only intersect or overlap at random sites along their interface, thereby providing a partial, natural barrier therebetween which is formed of the unfractured, low permeable areas where the upper end lower fractures are not in communication with each other.

After the reservoir has been fractured as described above, a drive fluid (e.g. water or hot water) is injected into the reservoir through the lower set of perfs in the wellbore casing. The water flows upward through the lower interval until it contacts the low permeable areas of the partial barrier. This causes the pressure to build in the lower interval and forces the drive water to spread outward into and through a greater portion of the lower fractured interval. As the water spreads outward, it displaces greater volumes of connate hydrocarbons (e.g. oil) ahead of it.

The displaced oil flows ahead of the injected drive fluid and seeks passage through the more permeable areas of the partial barrier into upper fractured interval. Since the permeable areas of the partial barrier are spaced from the wellbore, the oil and drive fluids will enter and inherently flow through a substantially greater portion of the upper interval than would be the case in a routine fractured, diatomaceous reservoir. The drive fluid pushes the displaced oil from both the lower and the upper intervals towards the upper set of perfs through which the oil and associated fluids are produced into the wellbore casing.

Since subsidence/compaction of diatomaceous reservoirs is also a serious problem due to the withdrawal (i.e. production) of the connate fluids, in accordance with the present invention, the oil in the reservoir is displaced into the fractured intervals by "imbibition". That is, drive water is injected through the lower perfs at approximately the same rate as that at which the fluids are produced through the upper perfs so that the oil can be imbibed into the fracture network, from which it can be produced along with the drive fluid. The produced fluids may then be processed at the surface to separate the produced oil from the water. The water may then be re-injected into the reservoir to continue the imbibition process.

BRIEF DESCRIPTION OF THE DRAWINGS

The actual construction, operation, and apparent advantages of the present invention will be better understood by referring to the drawings in which like numerals identify like parts and in which.

BEST KNOWN MODE FOR CARRYING OUT THE INVENTION

Figure 1:
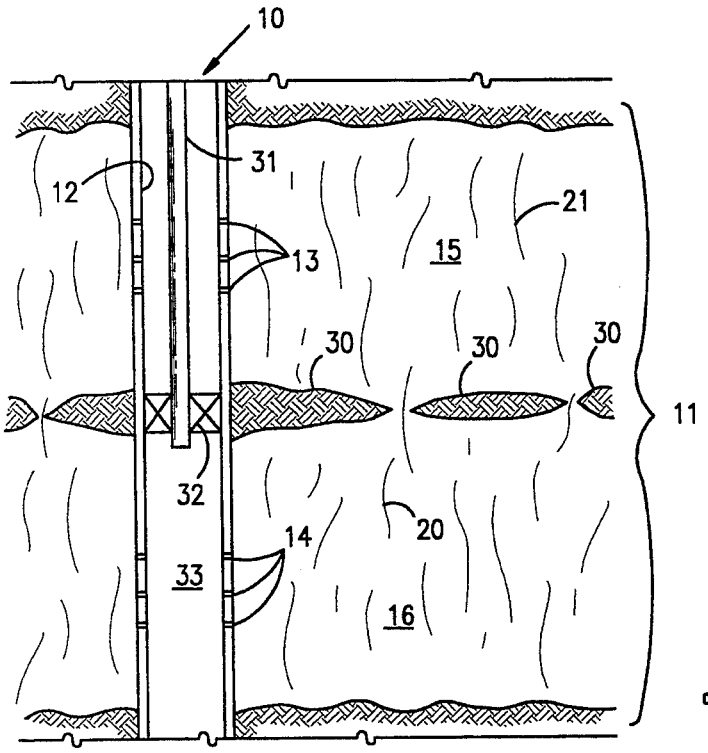
FIG. 1 is an elevational view, partly in section, of the lower end of a wellbore which has been completed through a low permeability reservoir which, in turn, has been fractured in accordance with the present invention.

Referring more particularly to the drawings, FIG. 1 illustrates a lower portion of a wellbore 10 which has been completed through a low permeability reservoir 11 such as those found in diatomaceous formations. A diatomaceous reservoir (i.e. formed primarily of diatomite) is capable of containing large volumes of valuable connate fluids (e.g. hydrocarbons/oil ) but is characterized by high porosity, high compressibility, and very low permeability (e.g. as low as 0.1 millidarcy) which makes the recovery of the fluids from these reservoirs extremely difficult. Wellbore 10 is shown as being cased throughout its length with a casing 12 which, in turn, is normally cemented (not shown) in place. Casing 12 extends into reservoir 11 and has a set of upper perforations (perfs) 13 and a set of lower perfs 14 which are strategically spaced from each other so that different intervals 15 and 16, respectively, can be individually hydraulically fractured from wellbore 10 through these perfs as will be explained below.

In accordance with the present invention, after wellbore 10 has been completed and perforated, casing 12 is isolated adjacent one of the sets of perfs and a first interval of reservoir 11 lying adjacent thereto is hydraulically fractured by any well known fracturing technique. It should be understood that the order in which intervals 15, 16 are fractured is not critical to the present invention but preferably, the lower interval 16 is fractured first. As will be understood by those skilled in the art, after isolating wellbore 10 adjacent perfs 14, a fracturing fluid is injected under high pressure through perfs 14 to thereby create a vertical fracture system (represented by lines 20 in FIG. 1) within lower interval 16.

The vertical fracture(s) in fracture system 20 extends outward for some distance into reservoir 11 and has a width (i.e. distance parallel to wellbore 10) which extends substantially across interval 16. The approximate height that the fracture(s) in lower interval 16 may extend in a particular fracturing operation can be predicted from prior fracturing data from similar reservoirs, core samples from the reservoir, the pressures and fluids used in the fracturing operation, well logs before and after fracturing, etc. Normally, the height of a vertical fracture(s) in a typical diatomaceous formation created by routine hydraulic fracturing operation ranges from about 50 to about 100 feet above and below the point where the fracturing fluid is injected. Of course, propping material (i.e. props such as sand, gravel, nut shells, etc.) can be injected into the formation along with the fracturing fluids to aid in maintaining the fracture(s) open after the fracturing operation has been completed.

After lower interval 16 has been fractured, the portion of wellbore 10 which lies adjacent upper perfs 13 is isolated and a second interval (e.g. upper interval 15) of reservoir 11 is hydraulically fractured to produce a second vertical fracture system 21, similarly as described above. There are several techniques for producing multiple fractures from a single wellbore well known in the art, for example, see U.S. Pat. Nos. 2,970,645; 3,028,914; 3,289,762, and 3,712,379, all incorporated herein by reference.

The upper and lower sets of perfs 13, 14, respectively, are spaced from each other at a prescribed distance so that all of the fracture(s) 21 in upper interval 15 will not overlap all of the fracture(s) 20 in lower interval 16 at all points along their lengths (i.e. distance into reservoir 11). That is, by controlling the spacing between perfs 13 and 14 (e.g. from about 50 to about 100 feet, depending on a particular reservoir), the reservoir 11 can be fractured so that the lower end of the upper vertical fracture(s) in upper fracture system 21 will begin to "play-out" as the fracture(s) approaches the upper end of the lower vertical fracture(s) in lower fracture system 20.

Accordingly, the lower end of the upper fractures and the upper end of the lower fractures will only intersect or overlap at random sites along their interface, thereby providing a partial, natural barrier as illustrated by hatched area 30. This barrier is formed of the unfractured, low permeable areas along the interface between intervals where the upper and lower fractures are not in communication with each other. Of course, the exact configuration of the fracture systems and barrier 30 may not appear exactly as shown in FIG. 1 since the illustration in FIG. 1 has been idealized to better illustrate the present invention. As will become evident from the following description, barrier 30 improves the sweep efficiency of drive fluids through reservoir 11 and hence, improves the recovery of connate fluids therefrom.

Referring again to FIG. 1, after reservoir 11 has been fractured as described above, a string of tubing 31 is lowered and packer 32 is set approximately adjacent to barrier 30 to isolate lower perfs 14 from upper perfs 13. A drive fluid (e.g. water or hot water) is flowed down through tubing 31 and through lower perfs 14 into reservoir 11. The water will flow into the fracture(s) 20 but is substantially blocked from taking a direct path to upper perfs 13 by partial barrier 30. Contact with barrier and the resulting increase in pressures force the water to spread outward into fracture system 20 thereby causing the water to pass through and contact a greater portion of reservoir 11 thereby displacing the hydrocarbons (e.g. oil) ahead of it.

The displaced oil from lower interval 16 will be forced ahead of the injected drive fluid and will seek passage through the more permeable areas of the partial barrier 30 (i.e. those points at which the vertical fracture(s) in the upper and lower fracture systems overlap) into upper interval 15 of reservoir 11. Since the permeable areas of barrier 30 are normally spaced along the interface between the fractured intervals at random distances from each other, a greater volume of upper interval 15 will be swept by the drive fluid as it flows through the spaced, permeable areas of barrier 30 towards upper perfs 13. The displaced oil and associated fluids are produced into casing 12 through upper perfs 13 and up through annulus 33 to the surface.

In addition to the low permeability associated with diatomaceous reservoirs, subsidence/compaction of the formation is also a serious problem due to the withdrawal (i.e. production) of the connate fluids. If the reservoir fluids are produced at a faster rate than the drive fluid is injected, the flow passages in the reservoir are prone to close thereby further decreasing the already low permeability of the reservoir. In accordance with the present invention, the oil in the low permeability matrix of reservoir 11 is displaced into the fracture systems 20, 21 by what is known as the "imbibition mechanism".

In the imbibition process of the present invention, the drive water is injected through the lower perfs 14 at approximately the same rate as the fluids are produced through the upper perfs 13. Some of the injected water will be imbibed into the tight matrix of the reservoir as a result of the high capillary pressures associated with low permeability formations and will displace at least some of the connate oil into the fracture network of systems 20, 21.

The oil and excess water flows upward through lower interval 16, through the permeable areas of barrier 30, and through upper interval 15 where additional imbibition takes place. The oil and remaining drive water are then produced into casing 12 through perfs 13. For a more complete discussion of an imbibition process, see U.S. Pat. No. 3,490,527, which is incorporated herein by reference. With sufficient injection flow rates and reservoir pressure, the produced fluids will flow to the surface through annulus 33.

Figure 3:
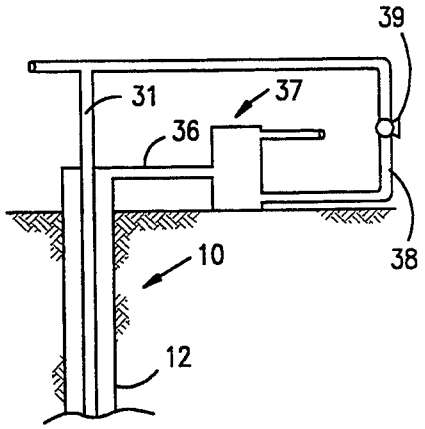
FIG. 3 is a schematical view of a surface processing system for use in the present invention.

Referring to FIG. 3, the produced fluids are flowed through casing head outlet 36 into a processing facility 37 (e.g. oil-water separator) in which the produced oil is separated from the water. The water is returned to wellbore 11 through line 38 via pump 39 for re-injection into reservoir 11 to continue the imbibition recovery of oil therefrom. Additional water may be added from a separate source (not shown) as may be necessary to balance the oil removed plus any fluid leak-off into the reservoir 11, which may be substantial in some operations.

Figure 2:
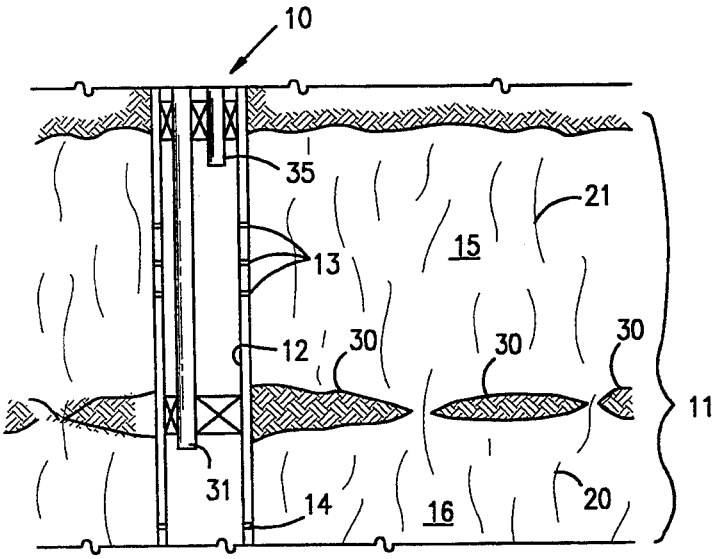
FIG. 2 is an elevational view, partly in section, of the lower end of a wellbore, similar to that of FIG. 1, wherein the wellbore has been completed in accordance with a further embodiment of the present invention.

FIG. 2 illustrates basically the same recovery operation as that just described except wellbore 10 has been dually-completed whereby drive fluid is injected through tubing 31 and the recovered fluids are produced to the surface through production tubing 35. This completion is especially useful when hot water is used as the drive fluid in the imbibition, recovery process since heat loss to annular fluids will be significantly reduced. Hot water (e.g. 250° F.) will lower the oil viscosity and increase the water wettability of the formation matrix, resulting in a higher driving force for imbibition. The produced fluids can be lifted through production tubing 35 by any one of several well known artifical lift methods, e.g. downhole pump.

What is claimed is:

1. A method for recovering connate fluids from a low permeability subterranean reservoir, said method comprising:

completing a wellbore into said reservoir;

fracturing said reservoir from a first position within said wellbore to create a first vertical fracture system within said reservoir;

fracturing said reservoir from a second position within said wellbore to create a second vertical fracture system within said reservoir; said second position being spaced from said first position within said wellbore whereby there will be only some of the fracture(s) in said first vertical fracture system overlap some of the fracture(s) in said second vertical fracture system whereby a natural, partial barrier to flow is formed between said fracture systems; and injecting a drive fluid into one of said first or second fracture systems and producing said connate fluids through the other of said first or second fracture systems.

2. The method of claim 1 wherein said wellbore has a casing extending into said reservoir and said casing is perforated adjacent both said first and said second positions within said wellbore.

3. The method of claim 1 wherein said low permeability reservoir is comprised primarily of diatomite and said connate fluids include hydrocarbons.

4. The method of claim 1 including:

injecting a drive fluid into the lower of said first or second fracture systems and producing said connate fluids through the upper of said first or second fracture systems.

5. The method of claim 4 wherein said first and said second positions within said wellbore are spaced from about 50 feet to about 100 feet apart.

6. The method of claim 5 wherein said wellbore is cased into said reservoir and said casing is perforated adjacent both said first and said second positions within said wellbore.

7. The method of claim 4 wherein said drive fluid is water.

8. The method of claim 7 wherein said water is heated.

9. The method of claim 7 wherein said connate fluids are produced into said wellbore by imbibition wherein the water is injected into said lower fracture system at a rate approximately equal to the rate at which the connate fluids are produced through said upper fracture system.

10. The method of claim 9 including:

processing said connate fluids to separate the water therefrom; and using said water for re-injection into said lower fracture system.

* * * * *